United States Patent [19]

Stranczek

[11] 4,093,834

[45] June 6, 1978

[54] PROTECTIVE COVER ARRANGEMENT

[75] Inventor: Norman J. Stranczek, Niles, Ill.

[73] Assignee: S&C Electric Company, Chicago, Ill.

[21] Appl. No.: 701,066

[22] Filed: Jun. 30, 1976

[51] Int. Cl.[2] ..... H01H 9/20

[52] U.S. Cl. ..... 200/50 A

[58] Field of Search ..... 200/50 A, 42 R, 42 T, 200/333, 334, 61.7, 50 C; 335/68

[56] References Cited

U.S. PATENT DOCUMENTS

| | | | |
|---|---|---|---|
| 1,565,006 | 12/1925 | Burns | 200/50 A |
| 1,801,228 | 4/1931 | Edhlund | 200/50 A |
| 3,283,608 | 11/1966 | Davis et al. | 200/42 T X |
| 3,508,179 | 4/1970 | Bernatt et al. | 335/68 |

*Primary Examiner*—James R. Scott
*Attorney, Agent, or Firm*—Kirkland & Ellis

[57] ABSTRACT

Motorized high voltage switch operating mechanisms may have local control switches located on the front thereof which may be operated to control the operation of the switch operating mechanism. It is desirable to limit access to the local control switches by a cover that may be locked to prevent unauthorized tampering or actuation. A cover is provided that is pivotable on a hinge to cover the switches. The cover is arranged so that it may be opened in two ways. First, when a lock is removed, the cover may be first moved upwardly to disengage a flange mounted on a door of the switch operating mechanism so that the cover can be pivoted to an open position. Second, even when the lock is in place, the door can be opened so that the flange disengages the cover so that the cover can be pivoted to an open position. A remote control blocking switch may be mounted beneath and normally engaged by the cover so that when the cover is opened, remote operation of the switch operating mechanism is blocked by disengagement of the switch from the cover.

23 Claims, 7 Drawing Figures

PROTECTIVE COVER ARRANGEMENT

BACKGROUND OF THE INVENTION

1. Field of the Invention

The present invention relates to protective cover arrangements and, more specifically, to protective cover arrangements for control switches of high voltage switch operating mechanisms.

2. Description of the Prior Art

Motor driven switch operating mechanisms for high voltage switch arrangements are well known in the art. For example, such a switch operating mechanism is described and illustrated in U.S. Pat. No. 3,508,179 — Bernatt et al. issued Apr. 21, 1970. Such switch operating mechanisms are designed so that a motor may be remotely controlled by appropriate control circuitry to drive a drive shaft connected to high voltage switches so that the switches may be opened or closed depending upon the desired operation. In some instances, since the control circuitry for the switch operating mechanism is remotely located with respect to the switch operating mechanism and the high voltage switches, it is desirable to provide control switches on the switch operating mechanism so that the switch operating mechanism can be operated while the operator visually inspects the operation of the switches. However, when such control switches are located on the switch operating mechanism, it is desirable to limit the access to such control switches so that unauthorized personnel cannot operate the control switches to open or close the high voltage switches. Further, it may be desirable to provide for two levels of service employees who can service such equipment. One class of employees may be authorized to only open the cover and operate the control switches whereas another class of employees may be authorized to not only open the cover to gain access to the control switches but to also gain access to the interior portions of the switch operator to perform maintenance.

Accordingly, it would be a desirable advance in the art to provide a protective cover arrangement which permits limited access to control switches on high voltage switch operators but which permits separate and independent levels of access by different classes of employees.

BRIEF DESCRIPTION OF THE INVENTION

The present invention is useful with a mechanism housing having a door thereon for closing or opening an access opening therein and a mechanism-operating member mounted externally on the housing.

An improved protective cover arrangement for the mechanism-operating member in accordance with the present invention includes a cover movable along a first and second paths. Movement of the cover along the first path is between a member-covering position and a member-exposing position. Movement of the cover along the second path is between a first location and a second location. The cover is movable along the first path at either location. With the cover in the first location and the member-covering position, stop means responsive to the door being closed interfere with the movement of the cover to prevent its movement along the first path toward the member-exposing position. However, the cover can be moved along the second path to the second location so that the cover is clear of the stop means, and it can now be moved along the first path to expose the member. Moreover, with the door open, the stop means does not interfere with the cover so that it can be freely moved along the first path. Lock means are also provided which, when secured, hold the cover in the first location but which allow the cover to move along the first path if the door is open so that the stop means does not interfere. Thus, with the door closed, the cover in the first location covering the member, and the lock secured, the cover is held in the member-covering position. If the door remains closed, but the lock is removed, the cover may be first moved to its second location until it clears the stop means and then moved to its member-exposing position. If the lock is secured, but the door is opened, the cover again may be moved to its member-exposing position along the first path.

In the specific embodiment described, the mechanism is an operating mechanism for a high-voltage switch and the member is an electrical switch for operating the mechanism. The cover is mounted to the housing for both pivotal movement (the first path) and vertical sliding movement (the second path). With the cover in the first location (vertically down) covering the switch and the door closed, a stop flange on the door prevents the cover from pivoting to expose the switch. The cover is free to move to the second location (vertically up), however, thereby allowing the cover to clear the stop flange so that the cover may be pivoted. If the door is opened, the flange does not interfere with the cover which is freely pivotable. A lock staple into which a lock shackle is insertable is provided in the housing. With the shackle in place, the cover is held in its vertically down position (first location), but is free to pivot (along the second path) if no other interference (i.e., stop flange) is present. Accordingly, with the door closed, the cover down covering the switch, and the lock shackle in place, the cover is held in its switch-covering position. If the door remains closed, but the shackle is removed, the cover may be first slid up (along the second path to the second location until the cover clears the stop flange) then pivoted along the first path to expose the switch. If the lock shackle is in place, but the door is opened, the cover may be pivoted to the switch-exposing position.

Thus, it is an object of the present invention to provide a protective cover which prevents access to an operating member for a housed mechanism when both a housing door is closed and a lock is in place, but which permits access to the member if either the door is opened or the lock is removed.

Another object of the present invention to provide a protective cover arrangement that prevents access to control switches on a high voltage switch operating mechanism when a cover is locked closed.

It is a further object of the present invention to provide a protective cover arrangement for high voltage switch operating mechanisms which permits opening of the cover to permit local operation of the control switches when the door of the switch operating mechanism is closed.

It is a further object of the present invention to provide a protective cover arrangement for high voltage switch operating mechanisms which permits the cover to be opened when the door of the switch operating mechanism is opened even when the lock is not removed.

It is a further object of the present invention to provide a protective cover arrangement for high voltage switch operating mechanisms which includes a remote-operation blocking switch which will operate to block remote operation of the switch operating mechanism when either the enclosure door or the cover is opened.

A further object of the present invention is to provide a protective cover arrangement for high voltage switch operating mechanisms which allows the enclosure door to be closed while the cover is opened so that the remote-operation blocking switch continues to block remote operation of the switch operating mechanism.

Yet a further object of the present invention is to provide a protective cover arrangement which allows the cover to be closed without locking it even when the enclosure door is closed to permit remote operation of the switch operating mechanism.

A further object of the present invention is to provide a protective cover arrangement for high voltage switch operating mechanisms which will remain in its open position once opened.

These and other objects, advantages, and features of the present invention shall hereinafter appear, and for the purposes of illustration, but not for limitation, an exemplary embodiment of the present invention is illustrated in the appended drawings.

DETAILED DESCRIPTION OF THE PREFERRED EMBODIMENT

Figure 1:
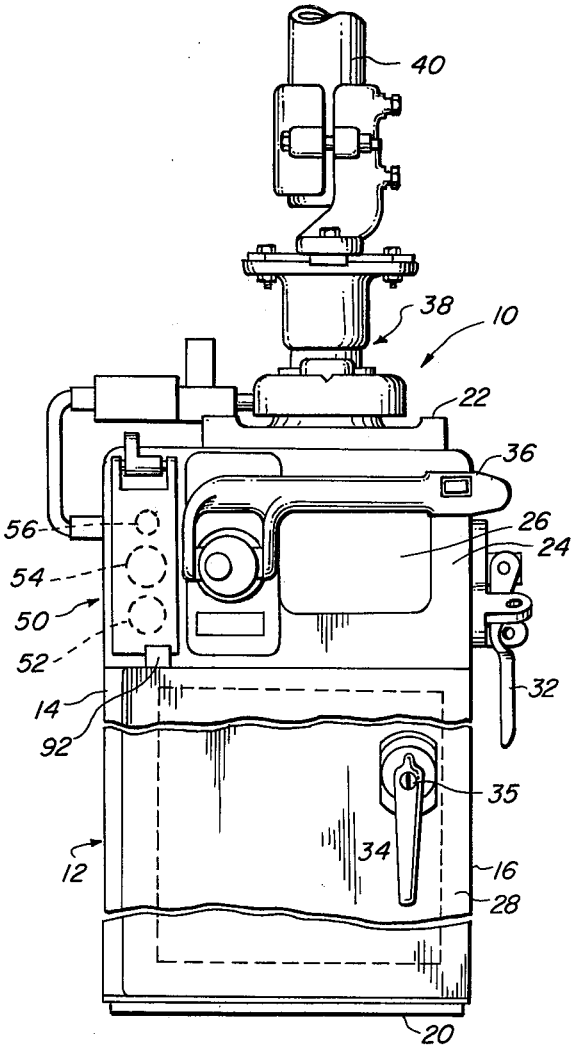
FIG. 1 is a front partially fragmentary view of a high voltage switch operating mechanism having a protective cover arrangement in accordance with the present invention mounted thereon.
Figure 2:
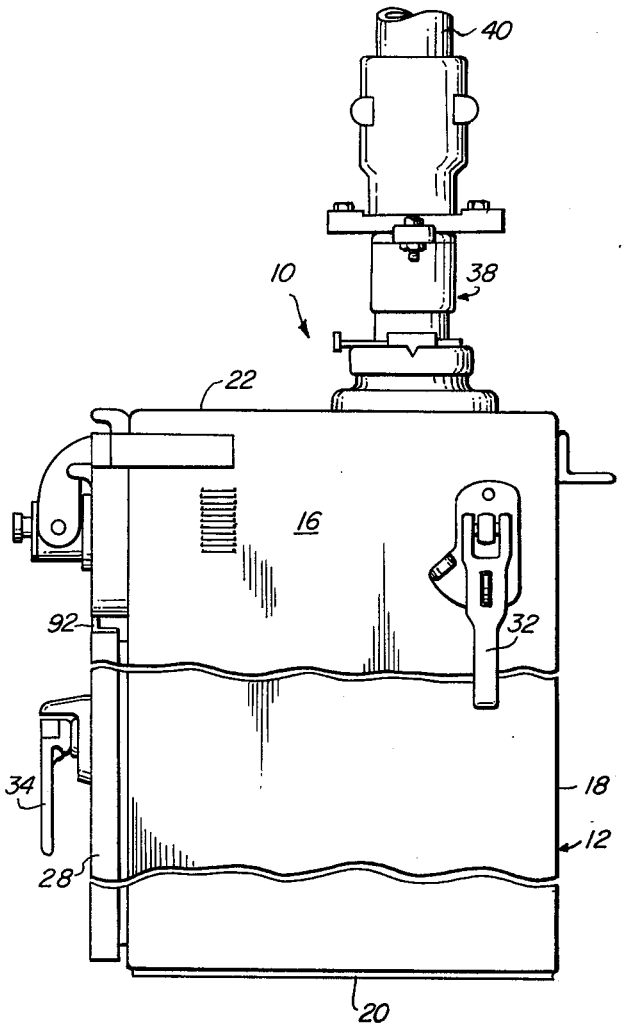
FIG. 2 is a side partially fragmentary view of the switch operating mechanism illustrated in FIG. 1.
Figure 3:
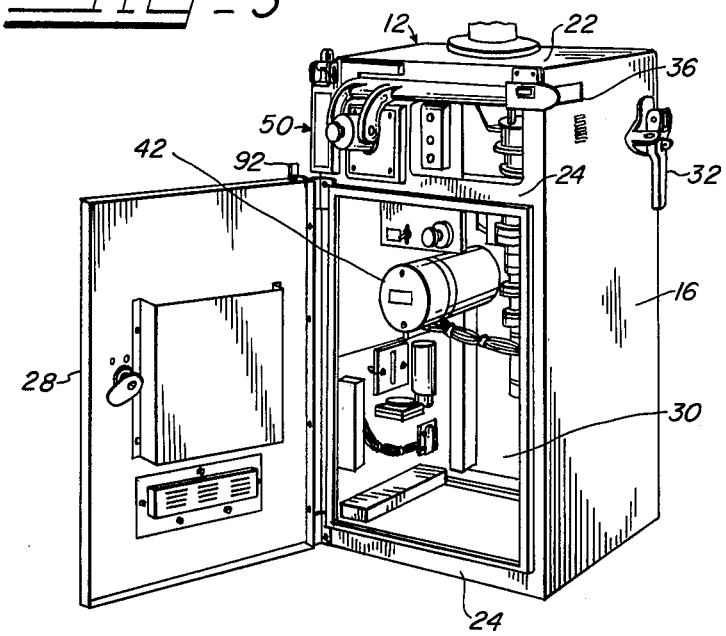
FIG. 3 is a right front perspective view of the switch operating mechanism in FIG. 1 showing the front door in an opened position.

With reference to FIGS. 1, 2, and 3, a switch operating mechanism 10 comprises an enclosed housing 12 including side walls 14 and 16, a back wall 18, a bottom wall 20, a top wall 22, and a front wall 24, having a transparent window 26 formed therethrough for viewing the internal portions of the switch operating mechanism 10. Also mounted on the front wall 24 is a front door 28 which is hinge-mounted to be opened to expose an access opening 30 into the internal portion of the enclosed housing 12 as shown in FIG. 3.

Mounted on side wall 16 is a selector handle 32. Mounted on door 28 is a door handle 34 that may be pivoted to open door 28. Handle 34 is typically locked in some convenient manner and may be provided with a lock 35 so that door handle 34 cannot be moved until a suitable key has been inserted and the lock 35 unlocked.

Mounted on front wall 24 is a hand crank 36 which is foldable from a stored position as illustrated in FIGS. 1, 2, and 3 to an operating position (not illustrated) so that the switch operating mechanism can be manually operated in the event of loss of power or at the option of the serviceman as more fully described in U.S. Pat. No. 3,508,179. Mounted to top wall 22 is coupling and bearing assembly 38 to which is connected a drive shaft 40 which extends upwardly and is connected to a gear box and operating mechanism for a three-phase, high voltage switch arrangement (not shown). A detailed description of the operation of mechanism 10 is contained in U.S. Pat. No. 3,508,179.

With reference to FIG. 3, a motor 42 is mounted within housing 12 and is connected through an appropriate gear train to a shaft extension (not shown) connected to coupling and bearing assembly 38 so that operation of motor 42 causes rotation of drive shaft 40 to cause operation of the high voltage switches. Motor 42 is ordinarily controlled by remote control circuitry which produces an operation of motor 42 to cause resultant operation of the high voltage switches depending upon the desired operation and the condition of the switches. The typical structure and function of the components contained within enclosed housing 12 are generally illustrated and described in U.S. Pat. No. 3,508,179 — Bernatt et al., issued Apr. 21, 1970. However, it should be understood that the exact structure of the components contained within housing 12 do not specifically form a part of the present invention, and the present invention may be used in conjunction with a variety of different well known switch operating mechanisms.

With reference to FIG. 1, a protective cover assembly 50 is shown in a closed position overlying control switches 52 and 54 and a remote control blocking switch 56 (shown in dotted lines).

Figure 4:
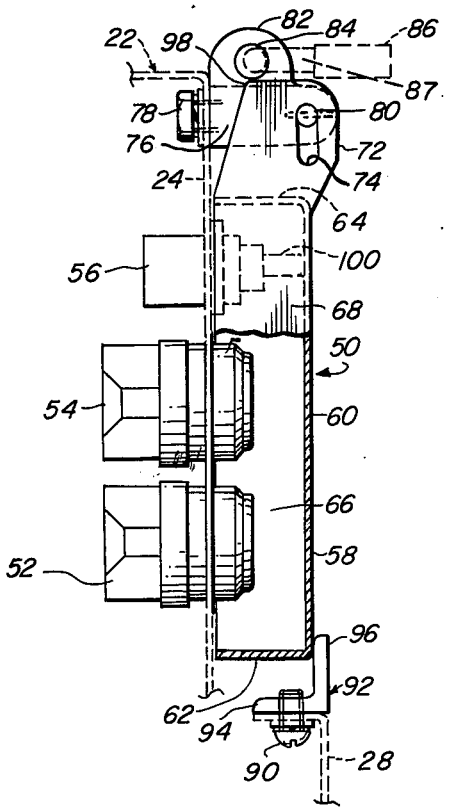
FIG. 4 is a side partially fragmentary, partially cross-sectional view of the protective cover arrangement in accordance with the present invention.
Figure 5:
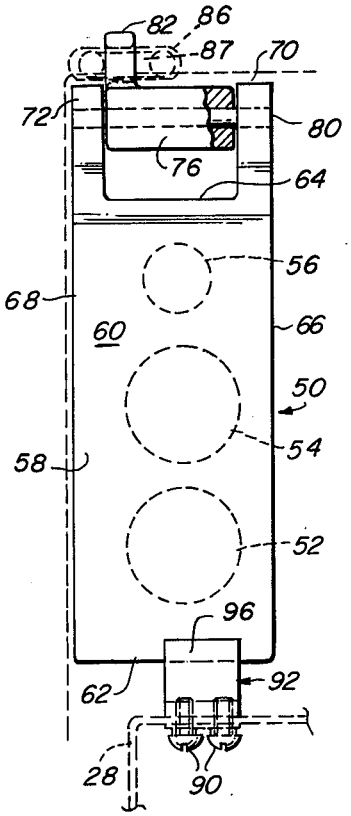
FIG. 5 is a front view of the protective cover arrangement illustrated in FIG. 4.

With reference to FIGS. 4 and 5, cover assembly 50 comprises a rectangular boxlike cover 58 comprising a front wall 60, a bottom wall 62, a top wall 64, and side walls 66 and 68. Mounted to the top of cover 58 are a pair of projecting arms 70 and 72 having formed therein slots 74. A hinge bracket 76 is mounted to front wall 24 by bolts 78. Mounted through a forwardly extended end of hinge bracket 76 is a pin 80 that extends into and is engaged by slots 74. Extending upwardly from the top of bracket 76 is a lock staple 82 having an opening 84 formed therethrough. A lock 86 (shown in dotted lines in FIGS. 4, 5, and 7) is shown with its shackle 87 in a locked position through opening 84.

Figure 6:
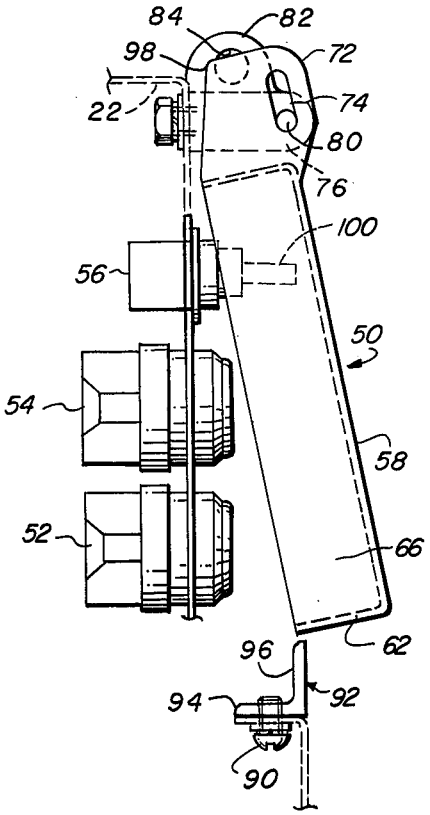
FIG. 6 is a side view of the protective cover arrangement in accordance with the present invention showing the protective cover arrangement moved to its upper second vertical position and being pivoted to an open position.
Figure 7:
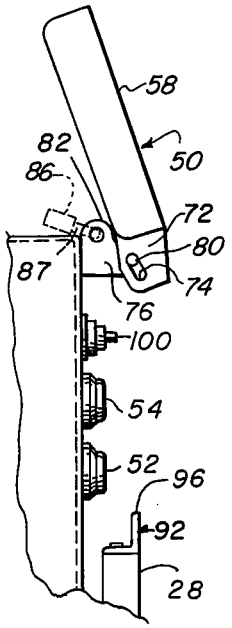
FIG. 7 is a side view of the protective cover arrangement in its open position.

The cover 58 is movable along a first circular path between a switch-covering position and a switch-exposing position. Specifically, in the exemplary embodiment depicted, this first path is pivotal about the pin 80 between the position which covers the switches 52, 54, 56 (FIG. 4) and the position which exposes the switches 52, 54, 56 (FIG. 7). The cover 58 is also movable along a second linear path between a first location and a second location. Specifically, in this exemplary embodiment, such a second linear path is transverse to the pin 80 along the slots 74 and constitutes vertical sliding of the cover 58 between the first location, with the cover 58 down, and the pin 80 at the top of the slots 74 as shown in FIG. 4, and the second location, with the cover 58 up and the pin 80 at the bottom of the slots 74 as shown in FIG. 6. Pivotal movement of the cover 58 along the first path can occur whether the cover 58 is in the first or the second location.

Obviously, the first and second paths may be other than those depicted. For example, the first path could be pivotal, as shown, while the second path could constitute either sliding of the cover 58 parallel to the pin 80, or rotation of the cover 58 in a plane parallel to the plane of the wall 24. Moreover, cover movement along the first path need not be pivotal, and may, for example, constitute any movement of the cover 58 away from front wall 24 and the switches 52, 54, 56. Specifically, movement of the cover 58 along the first path may take the form of cover movement normal to the plane of the wall 24, as by simple removal thereof, with no permanent attachment between the cover 58 and the wall 24. The important relationship between the paths of the cover 58 is that they be generally orthogonal so that, as described below, if the cover 58 is prevented from movement along one path, due to the existence of certain conditions, it may still move along the other path if certain other conditions exist. Specifically, in the preferred embodiment, if the lock 87 is in place with its shackle 87 in the opening 84, sliding movement of the cover along the second path away from the first location (FIG. 4) is prevented by the interference of the shackle 87 with an upper corner 98 of the arm 72. However, with the shackle 87 in the opening 84, and no other interference present, pivotal movement of the cover 58 along the first path can still occur. That is, with the cover 58 in the first location (FIG. 4) its pivoting about the pin 80 to the switch-exposing location (FIG. 7) can occur, because the corner 98 and the arm 72 are so dimensioned as to clear the shackle 87.

Mounted to the top edge of door 28 by screws 90 is an L-shaped flange 92. L-shaped flange 92 has one leg 94 through which screws 90 are attached and another leg 96 which extends upwardly and engages the lower edge of front wall 60 of the cover 58 when the door 28 and the cover 58 are both closed as shown in FIG. 4. Accordingly, with the door 28 closed, the cover 58 in the first location and the lock shackle 87 in place, the cover 58 is prevented from all movement, i.e., it cannot pivot because of the interference of the flange leg 96, and it cannot move to the second location because of the interference of the shackle 87. However, if lock 86 and its shackle 87 are removed, cover 58 can be moved upwardly to the second location since pin 80 is free to slide in slots 72 until the bottom of cover 58 clears the top edge of leg 96 so that cover 58 can be pivoted along the first path as illustrated in FIG. 6. Thus, even with the door 28 in a closed and locked position, by removal of lock 86, cover 58 can be moved upwardly and then pivoted to an open position to expose the switches 52, 54, and 56 (as illustrated in FIG. 7).

It is also possible to open cover 58 without removing lock 86 if door 28 is opened. For example, if door 28 is opened to the position illustrated in FIG. 3, leg 96 of flange 92 is moved away from engagement with cover 58 so that cover 58 can be pivoted along the first path as viewed in FIG. 4. During this opening procedure, cover 58 is merely pivoted around pin 80 so that the upper corner 98 of arm 72 pivots away from lock 86. Lock 86 can be pivoted 180° until it rests on top wall 22 (as shown by the dotted lines in FIG. 7) and cover 58 can be pivoted to an open position.

It should be obvious that the engagement of the cover 58 which prevents its moving along the first path when the door 28 is closed may be by means other than the flange 92. Moreover, such other means may be located elsewhere than on the top of the door 28 to interfere with the bottom of the cover 58. For example, the door 28 and the cover 58 may be side-by-side and the door 28 may have a member which engages the cover 58 from the side. The important characteristic of whatever interfering means is chosen is that, regardless of its nature or location, it prevents cover movement along the first path when the door 28 is closed, yet at the same time permits sufficient cover movement along the second path to clear the interfering means when the lock shackle 97 is removed. Of course, the location of the lock staple 82 with the lock shackle 87 therein must be such as to selectively prevent cover movement along the second path, yet permit movement along the first path when the door 28 is open.

Cover 58 is designed so that when it is pivoted to its open position, it will remain in its open position under the forces of gravity. In particular, with reference to FIG. 7, since the center of gravity of cover 58 is to the left of pin 80 when the cover is in its open position, the cover 58 will remain in the open position as illustrated in FIG. 7 until the serviceman pulls cover 58 back down to a closed position.

Remote control blocking switch 56 has a spring loaded plunger 100 which engages the interior surface of front wall 60 when cover 58 is in its closed position as illustrated in FIG. 4 thereby causing switch 56 to close to complete a circuit. Switch 56 may be connected between the remote control circuitry and motor 42 so that motor 42 can be operated by the control circuitry only when switch 56 is closed, i.e., when cover 58 is closed. When cover 58 is moved to an open position, spring loaded plunger is released allowing the plunger to move outwardly thereby opening switch 56. In this position, switch 56 is opened thereby breaking the circuit between the remote control circuitry and motor 42 so that motor 42 cannot be operated while cover 58 is in an open position. This feature prevents inadvertent operation of the switch operating mechanism while service is being performed on the switch operating mechanism 10.

If door 28 is opened, cover 58 will move outwardly slightly due to the spring bias of the plunger 100 as leg 96 disengages cover 58 so that switch 56 is opened even if cover 58 is not moved to its fully opened position as illustrated in FIG. 7. Thus, the mere opening of door 28 is sufficient to disconnect the remote control circuitry from motor 42. Further, any time cover 58 is opened, whether it is opened when door 28 is opened, or whether it is opened as previously described by removing lock 86 so that it can be moved upwardly to its second vertical position and then pivoted to an open position as illustrated in FIG. 6, switch 56 is opened so that motor 42 is disconnected.

Switch 52 is the close control switch and switch 54 is the open control switch. Actuation of switch 52 causes the motor to operate to close the high voltage switch if it is opened. Actuation of the switch 54 causes the switch operating mechanism to open the high voltage switch if it is closed. These switches are connected through appropriate circuitry within the switch operating mechanism 10 to effectuate the desired operation when actuated.

The present invention provides a means for limiting access to control switches 52 and 54 to two classes of employees. For example, it may be desirable for a utility to have one class of employees who are only authorized to have access to control buttons 52 and 54 for the purpose of operating mechanism 10. Further, it may be desirable to have another class of employees with greater experience and skill who are also authorized to have access to the internal portions of mechanism 10 for the purposes of performing repair and maintenance. In this instance, the one class of employees may be issued keys suitable for opening lock 86 but which cannot open lock 36 on door 28. This first class of employees, therefore, could only remove lock 86 and open cover 50 as previously described to gain access to switches 52 and 54. However, the second class of employees may be issued keys suitable for opening lock 36 so that they can open door 28 as well as open cover 58 when flange 92 is no longer in engagement with cover 58 so that this class of employees could both operate the switch mechanism by switches 52 and 54 as well as perform internal maintenance of mechanism 10. Because of the unique design of the cover arrangement in accordance with the present invention, it is not necessary for either employee to have both sets of keys.

It should be expressly understood that various changes, alterations, or modifications of the preferred embodiment illustrated herein may be made without departing from the spirit and scope of the present invention as defined in the appended claims.

I claim:

1. In a switch operating mechanism having a housing, a door overlying an access opening, the door being mounted for movement between a closed and an open position, and a mechanism control switch mounted externally on the housing, an improved protective cover arrangement comprising:

hinge means mounted on the housing adjacent the switch;

cover means mounted on said hinge means for movement between first and second locations and for pivotal movement at both locations between a closed position overlying the switch and an open position exposing the switch;

flange means mounted on the door adjacent said cover means for engaging said cover means when said cover means is in its first location so that said cover means is retained in its closed position when the door is closed and for disengaging said cover means when said cover means is moved to its second location so that said cover means can be pivoted to its open position even when the door is closed, said flange means moving out of engagement with said cover means when the door is opened so that said cover means can be pivoted to its open position when said cover means is in its first location; and locking means on said hinge means for receiving a removable lock, the presence of the lock in said locking means preventing said cover means from being moved from its first location to its second location, and the absence of the lock in said locking means permitting said cover means to be moved to its second location.

2. An improved cover arrangement, as claimed in claim 1, which further comprises switch means mounted adjacent the control switch for permitting operation of said mechanism in a first position and for blocking operation of said mechanism in a second position, said cover means holding said switch means in said first position when said cover means is in its closed position and permitting said switch means to move to said second position when said cover means is in its open position.

3. An improved cover arrangement, as claimed in claim 1, wherein said hinge means comprises:

a hinge bracket mounted on the housing, a pin extending from opposite sides of said hinge bracket, and lock staple extending above said hinge bracket and having an opening therethrough for receiving said lock means; and said cover means comprises:

a five-sided rectangular box member having a pair of projecting arms extending therefrom, each of said arms having a slot formed therein for receiving the ends of said pin so that said box member can move transversely to said pin along said slots, vertically down to said first location, said flange means engaging said box member at said first location, and vertically up to said second location, said flange means disengaging said box member at said second location.

4. An improved cover arrangement, as claimed in claim 3, wherein said slots are so oriented relative to the center of gravity of said box member that said cover means is held in its open position by the force of gravity when said cover means is moved from its closed position to its open position.

5. An improved cover arrangement, as claimed in claim 2, which further comprises biasing means for moving said switch means into said second position when said flange means disengages said cover means due either to said door being opened or said cover means being moved to its second location.

6. In an electrical mechanism having a metal housing and a control switch mounted externally on the housing, an improved protective cover arrangement comprising:

hinge means mounted on the housing adjacent the control switch;

cover means mounted on said hinge means for movement between first and second locations and for pivotal movement at both locations between a closed position overlying the switch and an open position exposing the switch;

stop means mounted adjacent said cover means for engaging said cover means when said cover means is in its first location so that said cover means is retained in its closed position and for disengaging said cover means when said cover means is moved to its second location so that said cover means can be pivoted to its open position; and locking means on said hinge means for receiving a removable lock, the presence of the lock in said locking means preventing said cover means from being moved from its first location to its second location and the absence of the lock in said locking means permitting said cover means to be moved to its second location.

7. An improved cover arrangement, as claimed in claim 6, which further comprises a remote control blocking switch mounted adjacent the control switch, said cover means engaging the remote control blocking switch when said cover means is in its closed position and disengaging the remote control blocking switch when said cover means is in its open position.

8. An improved cover arrangement, as claimed in claim 6, wherein:

said hinge means comprises:

a hinge bracket mounted on the housing, and a pin extending from opposite sides of said hinge bracket;

and said locking means comprises a lock staple extending above said hinge bracket and having an opening therethrough for receiving the removable lock; and said cover means comprises a five-sided rectangular box member having a pair of projecting arms extending therefrom, each of said arms having a slot formed therein for receiving the ends of said pin so that said box member can move transversely to said pin along said slots vertically down to said first location, said stop means engaging said box member at said first location, and vertically up to said second location, said stop means disengaging said box member at said second location.

9. An improved cover arrangement, as claimed in claim 8, wherein said slots are so oriented relative to the center of gravity of said box member that said cover means remains in its open position by the force of gravity when said cover means is moved from its closed position to its open position.

10. In a switch operating mechanism having a housing; a door overlying an access opening in the housing, the door being mounted for movement between a closed and an open position; and a control switch mounted externally on the housing, an improved protective cover arrangement comprising:

hinge means mounted on the housing adjacent the switch;

cover means mounted on said hinge means for movement between first and second locations and for pivotal movement at both locations between a closed position overlying the switch and an open position exposing the switch;

engaging means cooperating with said cover means and the door for retaining said cover means in its closed position when said cover means is in its first location and the door is closed, for allowing said cover means to be pivoted to its open position when said cover means is moved to its second location even when the door is closed, and for allowing said cover means to be pivoted to its open position when in its first location when the door is opened; and locking means on said hinge means for receiving a removable lock, the presence of the lock in said locking means preventing said cover means from being moved from its first location to its second location, and the absence of the lock in said locking means permitting said cover means to be moved to its second location.

11. For use with a mechanism enclosure of the type having an access opening therethrough, a door selectively movable to close or open the opening, and a mechanism-operating member on the enclosure's exterior; an improved cover of the type selectively movable along a first path between a member-covering position and a member-exposing position, wherein the improvement comprises:

means for mounting the cover adjacent to the enclosure for movement along a second path between a first and second location, the cover being movable along the first path in both the first and second locations;

lock means for selectively maintaining the cover in the first location; and stop means for preventing movement of the cover along the first path when the door closes the opening and the cover is in the first location, for permitting cover movement along the first path when either the door opens the opening and the cover is in the second location, and for permitting the cover to move along the second path from the second location when the cover is not maintained in the first location by lock means.

12. The cover of claim 11, wherein the stop means comprises:

a door-mounted flange which, when the door is closed, interferes with movement of the cover along the first path from the first cover location, but which permits cover movement parallel to the flange along the second path, and which, when the door is opened, does not interfere with cover movement along the first path.

13. The cover of claim 12, wherein the mounting means comprises:

a pin mounted to the enclosure; and a slotted arm on the cover, the slot receiving the pin for both pivotal movement of the cover about the pin and sliding movement of the cover transverse to the pin and longitudinally of the slot, the pivotal movement being along the first path and the sliding movement being along the second path.

14. The cover of claim 13, wherein the lock means comprises:

staple means on the enclosure for receiving a lock shackle, the cover being freely movable along the first path when the shackle is received in the staple and the door is opened, and being freely movable along the second path when the shackle is not received in the staple.

15. The cover of claim 11, wherein the mounting means comprises:

a pin mounted to the enclosure; and a slotted arm on the cover, the slot receiving the pin for both pivotal movement of the cover about the pin and sliding movement of the cover transverse to the pin and longitudinally of the slot, the pivotal movement being along the first path and the sliding movement being along the second path.

16. The cover of claim 15, wherein the stop means comprises:

a door-mounted flange which, when the door is closed, interferes with pivotal movement of the cover along the first path from the first cover location, but which permits sliding cover movement parallel to the flange along the second path, and which, when the door is opened, does not interfere with pivotal cover movement along the first path.

17. The cover of claim 16, wherein the lock means comprises:

staple means on the enclosure for receiving a lock shackle, the cover being freely pivotable along the first path when the shackle is received in the staple and the door is opened, and being freely slidable along the second path when the shackle is not received in the staple.

18. An improved enclosure for a mechanism, the enclosure being of the type having an opening permitting access to the mechanism, a door selectively movable to open or close the opening, and a mechanism-operating member on the enclosure's exterior; wherein the improvement comprises:

(a) a cover;

(b) means for mounting the cover and for
(1) permitting movement of the cover along a first path between a member-covering and a member-uncovering position, and
(2) permitting movement of the cover along a second path between a first and a second location;
(c) means for preventing movement of the cover along the first path to the member-uncovering position when the door is closed and the cover is in both the member-covering position and the first location, and for permitting cover movement along the first path when the cover is in the second location or when the door is open; and
(d) lock means for selectively preventing movement of the cover from the first location to the second location along the second path.

19. The enclosure of claim 18 wherein the first and second paths are generally orthogonal.

20. The enclosure of claim 19 wherein cover movement along the first path is pivotal toward and away from the enclosure and cover movement along the second path is sliding, generally parallel to the enclosure.

21. The enclosure of claim 20 wherein
the mounting means comprises:
a pin mounted to the cabinet; and
an arm on the cover, the arm having an elongated slot therein receiving the pin to permit both the pivotal movement of the cover about the pin and the sliding movement of the cover transverse to the pin and longitudinally of the slots;
the movement preventing means comprises a flange on the door which engages the cover remotely from the pin when the door is closed to prevent pivotal cover movement absent sufficient sliding cover movement to permit the cover to clear the flange; and
the locking means comprises a staple into which a lock shackle is insertable, the inserted shackle permitting the pivotal, but not the sliding, movement of the cover.

22. The enclosure of claim 21 wherein the mechanism is an electrical device operable both locally by the operating member, which is a first switch, and remotely, the enclosure further comprising:
a second switch which in a first position permits the remote operation of the device and in a second position prevents such remote operation;
means for biasing the second switch toward the second position; and
means on the cover for holding the second switch in the first position when the cover is in the first switch covering position and for permitting movement of the second switch to its second position when the cover is in the first switch uncovering position.

23. The enclosure of claim 22 wherein the biasing means is sufficiently strong to pivot the cover out of its first position and move the second switch to its second position whenever the cover is in its second location at the door is opened.

* * * * *